US010941953B2

(12) United States Patent
Goel et al.

(10) Patent No.: US 10,941,953 B2
(45) Date of Patent: Mar. 9, 2021

(54) HVAC SYSTEM AND METHOD OF CIRCULATING FLAMMABLE REFRIGERANT

(71) Applicant: Lennox Industries Inc., Richardson, TX (US)

(72) Inventors: Rakesh Goel, Irving, TX (US); Umesh Gokhale, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 83 days.

(21) Appl. No.: 16/162,934

(22) Filed: Oct. 17, 2018

(65) Prior Publication Data

US 2020/0124305 A1 Apr. 23, 2020

(51) Int. Cl.
*F24F 11/36* (2018.01)
*F24F 11/77* (2018.01)
(Continued)

(52) U.S. Cl.
CPC ..... *F24F 11/36* (2018.01); *F24F 11/77* (2018.01); *F24F 11/88* (2018.01); *F25B 49/02* (2013.01);
(Continued)

(58) Field of Classification Search
CPC .. F24F 11/36; F24F 11/77; F24F 11/88; F24F 11/52; F24F 11/74; F24F 11/39;
(Continued)

(56) References Cited

U.S. PATENT DOCUMENTS 10,488,072 B2 * 11/2019 Yajima ..... F24F 7/007
2010/0282076 A1 * 11/2010 Fox ..... F24F 3/0442 95/25
(Continued)

FOREIGN PATENT DOCUMENTS

CN 108119984 A 6/2018
GB 2547583 A 8/2017
(Continued)

OTHER PUBLICATIONS

European Patent Office, Extended European Search Report, Application No. 19196885.8, dated Mar. 30, 2020, 8 pages.
(Continued)

*Primary Examiner* — Kun Kai Ma
(74) *Attorney, Agent, or Firm* — Baker Botts L.L.P.

(57) ABSTRACT

A controller of a heating, ventilation, and air conditioning (HVAC) system, the controller comprising instructions that cause the controller to determine an air flowrate of an air blower of the HVAC system and calculate a threshold value based on a minimum required air flowrate. The controller further comprises instructions that cause the controller to send a notification to an operator of the HVAC system indicating that the air flowrate of the air blower is less than the threshold value in response to determining that the air flowrate of the air blower is less than the threshold value and shut down the HVAC system such that the refrigerant is no longer circulated by the componentry of the HVAC system in response to determining that the air flowrate of the air blower is less than the minimum required air flowrate.

20 Claims, 3 Drawing Sheets

(51) Int. Cl.
*F24F 11/88* (2018.01)
*F25B 49/02* (2006.01)

(52) U.S. Cl.
CPC ..... *F25B 2400/12* (2013.01); *F25B 2500/222* (2013.01); *F25B 2600/11* (2013.01); *F25B 2700/13* (2013.01)

(58) Field of Classification Search
CPC ... F24F 2140/10; F24F 2110/50; F25B 49/02; F25B 2500/222; F25B 2600/11; F25B 2700/13
See application file for complete search history.

(56) References Cited

U.S. PATENT DOCUMENTS

2019/0331377 A1* 10/2019 Matsuda ..... F25B 49/02
2019/0338971 A1* 11/2019 Yoneyama ..... F24F 11/77
2020/0011560 A1* 1/2020 Minamida ..... F24F 11/36
2020/0049361 A1* 2/2020 Minamida ..... F24F 11/36
2020/0124305 A1* 4/2020 Goel ..... F24F 11/74

FOREIGN PATENT DOCUMENTS

KR 1020140094813 7/2014
WO 2018158912 A1 9/2019

OTHER PUBLICATIONS

Kowald, G. W. et al., "Refrigerant Pump Down for an HVAC System," U.S. Appl. No. 16/163,260, filed Oct. 17, 2018, 30 pages.
Crawford, C. T. et al., "Systems and Methods for Pumping Down Flammable Refrigerant," U.S. Appl. No. 16/256,319, filed Jan. 24, 2019, 36 pages.
Crawford, C. T. et al., "Systems and Methods for Pumping Down Flammable Refrigerant," U.S. Appl. No. 16/256,378, filed Jan. 24, 2019, 36 pages.

* cited by examiner

HVAC SYSTEM AND METHOD OF CIRCULATING FLAMMABLE REFRIGERANT

TECHNICAL FIELD

This disclosure relates generally to operating a heating, ventilation, and air conditioning ("HVAC") system. More specifically, this disclosure relates to an HVAC system and method of circulating a flammable refrigerant.

BACKGROUND

Heating, ventilation, and air conditioning ("HVAC") systems can be used to regulate the environment within an enclosed space. Typically, an air blower is used to pull air from the enclosed space into the HVAC system through ducts and push the air back into the enclosed space through additional ducts after conditioning the air (e.g., heating, cooling or dehumidifying the air). Various types of HVAC systems, such as residential and commercial, may be used to provide conditioned air for enclosed spaces.

Each HVAC system typically includes a HVAC controller that directs the operation of the HVAC system. The HVAC controller can direct the operation of a conditioning unit, such as an air conditioner or a heater, to control the temperature and humidity within an enclosed space.

SUMMARY OF THE DISCLOSURE

According to one embodiment, a heating, ventilation, and air condition ("HVAC") system operable to condition an enclosed space comprises componentry, an air blower, and a controller. The componentry is operable to circulate refrigerant and the air blower is operable to push air into the enclosed space. The controller comprises processing circuitry and a computer readable storage medium comprising instructions that, when executed by the processing circuitry, cause the controller to determine an air flowrate of the air blower and calculate a threshold value based on a minimum required air flowrate, wherein the minimum air flowrate is calculated based on a mass of the refrigerant in the HVAC system and a lower flammability limit corresponding to the refrigerant and the threshold value is greater than the minimum air flowrate. The controller further comprises instructions that, when executed by the processing circuitry, cause the controller to send a notification to an operator of the HVAC system indicating that the air flowrate of the air blower is less than the threshold value in response to determining that the air flowrate of the air blower is less the threshold value and shut down the HVAC system such that the refrigerant is no longer circulated by the componentry of the HVAC system in response to determining that the air flowrate of the air blower is less than the minimum required air flowrate.

According to another embodiment, a method of operating a heating, ventilation, and air condition ("HVAC") system includes determining, by one or more controllers of the HVAC system, an air flowrate of an air blower of the HVAC system and calculating, by the one or more controllers, a threshold value based on a minimum required air flowrate, wherein the minimum air flowrate is calculated based on a mass of the refrigerant in the HVAC system and a lower flammability limit corresponding to the refrigerant and the threshold value is greater than the minimum air flowrate. The method further includes sending, by the one or more controllers, a notification to an operator of the HVAC system indicating that the air flowrate of the air blower is less than the threshold value in response to determining that the air flowrate of the air blower is less the threshold value and shutting down, by the one or more controllers, the HVAC system such that the refrigerant is no longer circulated by the componentry of the HVAC system in response to determining that the air flowrate of the air blower is less than the minimum required air flowrate.

According to yet another embodiment, a controller comprises processing circuitry and a computer readable storage medium comprising instructions that, when executed by the processing circuitry, cause the controller to determine an air flowrate of an air blower of the HVAC system and calculate a threshold value based on a minimum required air flowrate, wherein the minimum air flowrate is calculated based on a mass of the refrigerant in the HVAC system and a lower flammability limit corresponding to the refrigerant and the threshold value is greater than the minimum air flowrate. The controller further comprises instructions that, when executed by the processing circuitry, cause the controller to send a notification to an operator of the HVAC system indicating that the air flowrate of the air blower is less than the threshold value in response to determining that the air flowrate of the air blower is less the threshold value and shut down the HVAC system such that the refrigerant is no longer circulated by the componentry of the HVAC system in response to determining that the air flowrate of the air blower is less than the minimum required air flowrate.

Certain embodiments may provide one or more technical advantages. For example, an embodiment of the present invention ceases operation of an HVAC system circulating a flammable refrigerant when it determines that continuing operation of the HVAC system would result in a risk of fire/flame. As another example, an embodiment of the present disclosure may notify an operator of potential flammability issues with an HVAC system circulating a flammable refrigerant. As yet another example, an HVAC system may recommend particular actions to an operator of the HVAC system to mitigate issues with an HVAC system circulating a flammable refrigerant. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
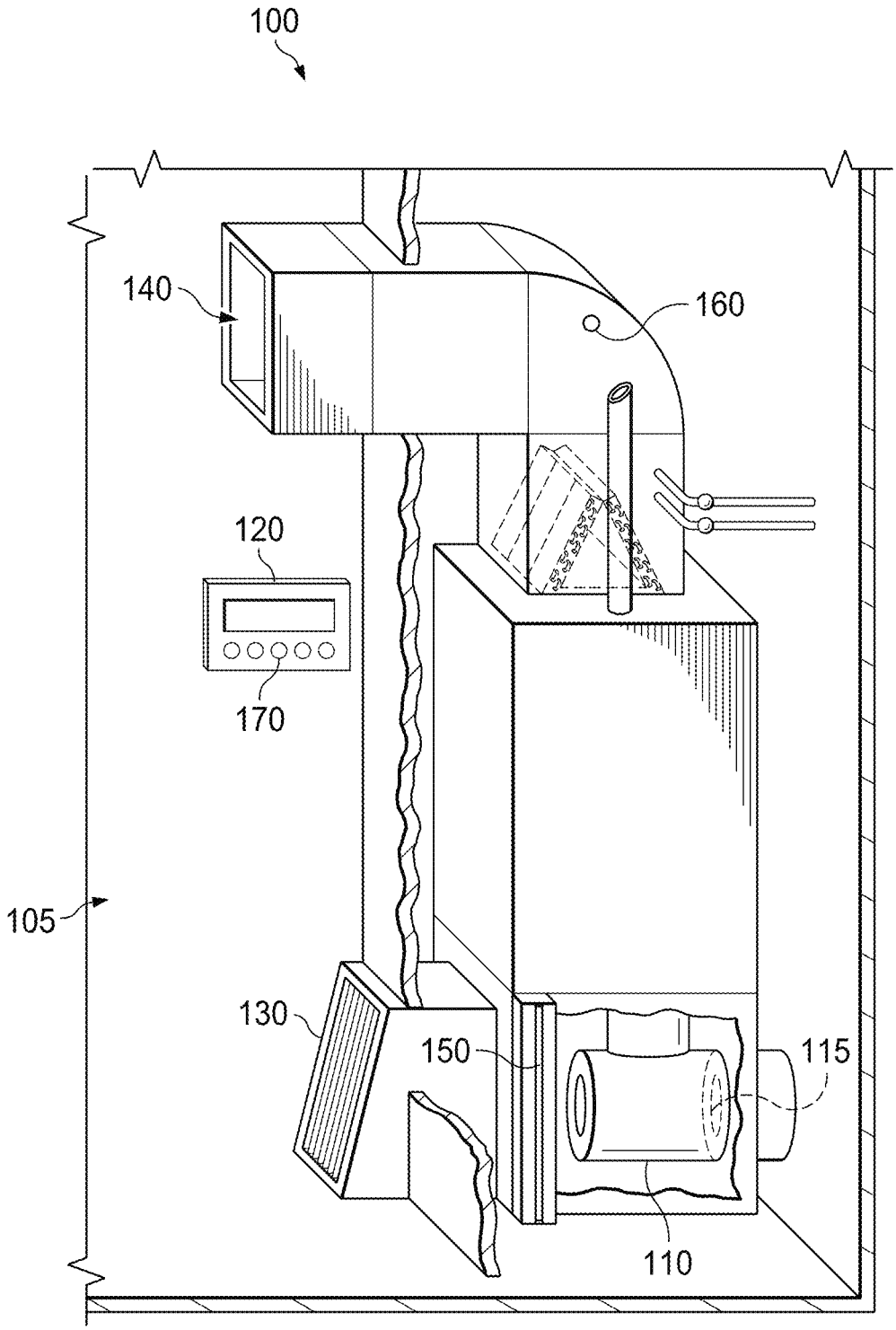
FIG. 1 illustrates an example of a heating, ventilation, and air condition ("HVAC") system operable to circulate flammable refrigerant, according to certain embodiments.

Embodiments of the present disclosure and its advantages are best understood by referring to FIGS. 1 through 4 of the drawings, like numerals being used for like and corresponding parts of the various drawings.

Recent initiatives to mitigate global warming have brought conventional refrigerants into the spotlight. Chlorofluorocarbons ("CFCs") are a popular type of refrigerant presently used in conventional HVAC systems. Although CFCs are highly stable compounds and are effective refrigerants, CFCs are known to contribute to ozone depletion. Specifically, CFCs are known to have a greater trapping power and longer atmospheric lifetime than other types of refrigerants. In view of the negative long-term effects of using CFCs, HVAC manufacturers and other interested persons are identifying other compounds that may have a lesser impact on the environment. One issue that must be contended with is that the more environmentally-friendly compounds are inherently less stable and thus are also more flammable than conventional refrigerants. As such, while use of environmentally-friendly compounds may decrease the risk of endangering the environment, use of environmentally-friendly compounds may increase the risk of fire and/or flame within an enclosed space that is conditioned using environmentally-friendly refrigerants.

Although refrigerant is generally contained within an HVAC system during operation, faulty componentry and/or wear-and-tear may cause an HVAC system to spring a refrigerant leak. Leakage of a flammable refrigerant may result in an unintentional flame and/or fire. To mitigate the risk of flame and/or fire, this disclosure recognizes diluting and mixing a flammable refrigerant below its flammability point by operating the HVAC system at or above a certain air flowrate. Additionally, this disclosure generally recognizes performing one or more safety checks to ensure that a flammable refrigerant is sufficiently diluted and mixed. This disclosure also recognizes notifying an operator of an HVAC system when it is determined that there is a reduction in the ability of the HVAC system to provide a desired speed of air (e.g., 1900 cubic feet per minute ("CFM")). This disclosure further recognizes discontinuing operation of the HVAC system when it is determined that the HVAC system is not capable of diluting the amount of refrigerant in the HVAC system.

An operator may use the following equation to determine the minimum air flowrate needed to safely operate an HVAC system circulating a flammable refrigerant:

$$Q=1000\times\text{MASS-refrigerant}/\text{LFL}$$

wherein Q represents air flowrate in CFM, MASS-refrigerant represents the mass of refrigerant in the HVAC system, and LFL represents the low flammability limit of the refrigerant in the HVAC system. As known by one of ordinary skill in the art, each refrigerant is associated with a particular LFL. For example, TABLE 1 below identifies the LFL for various exemplary flammable refrigerants:

TABLE 1

| Refrigerant | LFL |
|---|---|
| R32 | 0.019 lb/ft$^3$ |
| R1234yf | 0.018 lb/ft$^3$ |

The Q in the above equation represents the minimum air flowrate of an HVAC system needed to circulate a particular type of refrigerant in order to dilute the refrigerant below its flammability point. For example, an HVAC system circulating fourteen (14) pounds of R32 would need to operate an air blower at a minimum speed of approximately 733 CFM to mitigate the risk of fire/flame in the event that a refrigerant leak occurs. In other words, the Q in the above equation refers to a safety-based air flowrate for an HVAC system.

This disclosure also recognizes a second type of air flowrate—a comfort-based air flowrate. To distinguish between these two air flowrates, this disclosure will refer to the safety-based air flowrate as $Q_s$ and refer to the comfort-based air flowrate as $Q_c$. Unlike $Q_s$, $Q_c$ is not calculated based on a refrigerant type and the mass of such refrigerant. Rather, the value of $Q_c$ is a preference of a particular user and generally refers to an air flowrate that provides a user with a comfortable environment. Typically, $Q_c$ is between 200 and 400 CFM per ton. Thus, a 2-ton HVAC system is typically configured to have a $Q_c$ between 400 and 800 CFM and a 5-ton HVAC system is typically configured to have a $Q_c$ between 1000 and 2000 CFM.

The distinction between $Q_c$ and $Q_s$ is further clarified by the following examples: (1) an enclosed space may not be at risk for fire/flame but an occupant of the enclosed space may feel uncomfortable; and (2) an enclosed space may be at risk for fire/flame but an occupant of the space may be physically comfortable. The first example may occur when $Q_c$ is greater than $Q_s$. In such case, the HVAC system would fail to provide a volume of air necessary to ensure an occupant's comfort before it failed to provide the volume of air necessary to reduce the risk of fire/flame in an enclosed space. That is, an occupant would likely feel uncomfortable within an enclosed space before a risk of fire/flame developed due to a failure to sufficiently dilute a flammable refrigerant. Thus, in certain instances, an occupant may be able to detect that an issue exists with respect to his/her HVAC system well in advance of there being a risk of fire/flame in the enclosed space. The second example may occur when $Q_s$ is greater than $Q_c$. In such circumstance, the HVAC system would fail to provide a volume of air necessary to reduce the risk of fire/flame before it failed to provide the volume of air necessary to ensure an occupant's comfort. This is a particularly notable situation given that an occupant may not notice or realize that the HVAC system is not working properly (e.g., failing to sufficiently dilute a flammable refrigerant below that refrigerant's LFL). As an example, a 2-ton HVAC system circulating R32 will likely lose the ability to provide $Q_s$ before losing the ability to provide $Q_c$.

As mentioned above, this disclosure recognizes various ways to mitigate fire/flame risk as a result of circulating a flammable refrigerant. As will be described in more detail below, the HVAC system described herein may notify an operator when it determines that the HVAC system is not providing, or may soon be unable to provide, a volume of air sufficient to dilute a flammable refrigerant. In certain embodiments, the HVAC system may cease to operate upon a determination that the HVAC system is not providing a volume of air sufficient to dilute a flammable refrigerant. The HVAC system may also recommend specific actions to operators in response to detecting certain issues with HVAC system (e.g., may send a notification to an operator recommending that an air filter be changed or that the HVAC system be inspected for leaks). In some embodiments, one or more of the above determinations are based in part on information from a blower motor and/or one or more sensors (e.g., static pressure sensor, gas sensor). Being able to detect and/or determine one or more of these circumstances is beneficial as doing so may mitigate damage to persons and/or property surrounding an HVAC system and mitigate damage to the HVAC system itself.

FIG. 1 illustrates an example of an HVAC system 100. Generally, HVAC system 100 is configured to provide air to an enclosed space 105. HVAC system 100 includes at least one blower 110 and at least one controller 120. As depicted in FIG. 1, HVAC system 100 may also include a return air duct 130 and an air supply duct 140. In some embodiments, air is sucked out an enclosed space 105 through return air duct 130 and is filtered by one or more air filters 150. The filtered air is then generally pushed by blower 110 across conventional conditioning elements (e.g., evaporator coil 160 and refrigerant tubing 170) before it is circulated back into enclosed space 105 via air supply duct 180.

Blower 110 is configured to move air through HVAC system 100 (e.g., via return air duct 150 and air supply duct 180). In some embodiments, blower 110 is driven by a motor 115. Motor 115 may be operated at one or more speeds to provide a necessary and/or desirable air flowrate. This disclosure recognizes that operating motor 115 at a higher speed provides an increased air flow rate relative to operating motor 115 at a lower speed. In some embodiments, controller 110 controls the operation of motor 115. As such, controller 110 may instruct motor 115 to power on, power off, increase speed, and/or decrease speed. For example, controller 110 may instruct motor 115 to power on (from an off mode) and operate at a speed corresponding to an air flow rate of 600 cubic feet per minute ("CFM"). Controller 110 may further instruct motor 115 to increase speed (e.g., operate at a speed corresponding to an air flow rate of 800 CFM) and/or decrease speed (e.g., operate at a speed corresponding to an air flow rate of 400 CFM).

As described above, the air moved by blower 110 is eventually directed through air filter 120 via return air duct 150. Air filter 120 is configured to increase the quality of the air circulating in HVAC system 100 by entrapping pollutants. Pollutants may include particulates such as dust, pollen, allergens (e.g., dust mite and cockroach), mold, and dander. Pollutants may also include gases and odors such as gas from a stovetop, tobacco smoke, paint, adhesives, and/or cleaning products. Over time, as air filter 120 collects pollutants, air filter 120 becomes soiled and has no usable life left in it. This disclosure recognizes that an air filter having no usable life increases the external static pressure of the HVAC system, resulting in a higher cost to HVAC system 100 as compared to operating the HVAC system with an air filter having usable life. For example, blower 110 may require 0.925 KW of energy to move 1365 CFM when an air filter having usable life is installed within HVAC system 100 but requires 1.07 KW of energy to move the same amount of air when an air filter having no usable life is installed within HVAC system 100. To avoid these and other disadvantages, it is recommended that air filters are cleaned and/or replaced when they have no usable life left. As used herein, external static pressure refers to the pressure differential between air supply duct 140 and return air duct 130.

This disclosure also recognizes that HVAC system 100 may not be able to achieve a configured air flowrate for a variety of reasons. For example, even though 5-ton HVAC system 100 may be configured to have a $Q_c$ between 1000 and 2000 CFM, the actual air flowrate of blower 110 may be below the configured $Q_c$ (e.g., actual air flowrate of blower 110 may be 950 CFM). In some instances, a failure to achieve a configured $Q_c$ may be due to a soiled air filter. Typically, motor 115 is capable of providing its full range of CFM when the external static pressure of the HVAC system is below 0.9 inches of water column (inch wc). As air filter 150 loads, the external static pressure of the HVAC system increases. Accordingly, blower 110 may lose its ability to provide the configured $Q_c$ once external static pressure meets or exceeds 0.9 inch wc. This is particularly an issue when circulating flammable refrigerant given that a failure to maintain a particular air flowrate can result in fire/flame within the enclosed space. In view of this issue, this disclosure recognizes monitoring the external static pressure of HVAC system 100 and notifying an operator as one or more external static pressure thresholds are exceeded. For example, controller 120 may send one or more notifications to an operator indicating that the external static pressure of HVAC system 100 exceeds 0.85 inch wc. and 0.9 inch wc. In some embodiments, the notification corresponding to the 0.85 inch wc. determination also includes a suggestion to the operator to change air filter 150 soon. In other embodiments, the notification corresponding to the 0.9 inch wc. determination includes a suggestion to change air filter 150 immediately.

HVAC system 100 may also include one or more sensors 160. Sensors 160 may be configured to sense information about HVAC system 100, about enclosed space 105, and/or about components of HVAC system 100. As an example, HVAC system 100 may include a sensor 160 configured to sense data about a gas leak within HVAC system 100. As another example, HVAC system 100 may include one or more sensors configured to sense data about the external static pressure of HVAC system 100. As yet another example, one or more sensors may be configured to sense data related to a temperature of enclosed space 105. Although this disclosure describes specific types of sensors, HVAC system 100 may include any other type and any suitable number of sensors 160.

This disclosure also recognizes that certain components of HVAC system 100 may also be able to sense or determine data about HVAC system 100, about enclosed space 105, and/or about components of HVAC system 100. As an example, this disclosure recognizes that motor 115 may be configured to determine the torque and/or rotations per minute (RPM) of motor 115. As another example, motor 115 may be configured to determine external static pressure of HVAC system 100 (e.g., as a function of the torque and RPM of motor 115). Controller 120 may also be configured to determine these and other values (e.g., by receiving torque and RPM data from motor 115). For example, controller 120 may be configured to determine external static pressure of HVAC system 100 as a function of the torque and RPM of motor 115 in response receiving such information from motor 115.

As provided above, HVAC system 100 includes at least one controller 120 that directs the operations of HVAC system 100. Controller 120 may be communicably coupled to one or more components of HVAC system 100. For example, controller 120 may be configured to receive data sensed by sensors 160 and/or other components of HVAC system 100 (e.g., motor 115). As another example, controller 120 may be configured to provide instructions to one or more components of refrigeration system 100 (e.g., motor 116). Controller 120 may be configured to provide instructions via any appropriate communications link (e.g., wired or wireless) or analog control signal. An example of controller 120 is further described below with respect to FIG. 4. In some embodiments, controller 120 includes or is a computer system. As depicted in FIG. 1, controller 120 is located within a wall-mounted thermostat in enclosed space 105. Operation of HVAC system 100 may be controlled by an operator who programs HVAC system 100 using one or more buttons 170 on the thermostat. For example, HVAC system 100 may be programmed to initiate a cooling cycle in response to determining user input via buttons 170.

Controller 120 comprises processing circuitry and a computer readable storage medium. The computer readable storage medium may comprise instructions that, when executed by the processing circuitry, cause the controller to perform one or more functions described herein. As an example, controller 120 may provide instructions to cease all operations to one or more components of HVAC system 100 (e.g., motor 110, compressors (not depicted), condensers (not depicted), fans (not depicted)). In some embodiments, controller 120 sends such instruction in response to determining that the air flowrate of blower 110 is not sufficient to dilute the refrigerant circulating through HVAC system 100. The following is an example of an algorithm that may be executed by the controller 120 in order to provide an instruction to shut down HVAC system 100: (1) determine what type of refrigerant is circulating through HVAC system 100; (2) determine the LFL of the refrigerant circulating through HVAC system 100; (3) determine the $Q_s$ for the refrigerant circulating through HVAC system 100; (4) determine the air flowrate of blower 110; (5) determine that the air flowrate of blower 110 is not equal to or greater than the $Q_s$ for the refrigerant. Some of the data used by controller 120 to execute such algorithm may be sensed by one or more components of HVAC system 100 (e.g., motor 115, sensor 160). As an example, motor 115 may determine the air flowrate of blower 110. Other data used by controller 120 to execute the above algorithm may be calculated based on one or more equations stored to a storage device (e.g., memory 420 of controller 400). For example, controller 120 may calculate the $Q_s$ for a particular type of refrigerant based on the equation provided above. As another example, controller 120 may calculate the air flowrate of blower 110 based on torque and RPM data received from motor 115. Controller 120 may also receive (e.g., via interface 310) data used to execute the above-described algorithm. For example, controller 120 may receive data regarding the type and weight of refrigerant circulating in HVAC system 100 from a manufacturer and/or operator of HVAC system 100. As another example, controller 120 may receive data regarding the LFL of the refrigerant circulating in HVAC system 100.

Controller 120 may also provide other types of instructions. For example, as explained above, controller 120 may be configured to alert an operator of HVAC system 100 when it determines that air filter 150 should be changed soon or should be changed immediately. In other embodiments, controller 120 is configured to alert an operator of HVAC system 100 when it determines that the air flowrate of blower 110 is decreasing quicker than a threshold rate. In yet other embodiments, controller 120 is configured to alert an operator of HVAC system 100 when it determines that the air flowrate of blower 110 exceeds $Q_s$ for the refrigerant circulating in HVAC system 100 by a threshold percentage (e.g., 15%). Taking the above example of a HVAC system circulating 14 pounds of R32, controller 120 may alert an operator of HVAC system 100 when the air flowrate of blower 110 drops to 15% above the LFL for R32 (approximately 843 CFM). Additional notifications may also be set up by a manufacturer and/or operator of HVAC system 100. For example, operator of HVAC system 100 may program HVAC controller 120 to send notifications to his/her personal device when controller 120 determines that the air flowrate of blower 110 drops to 10% and 5% above the LFL for the refrigerant circulating through HVAC system 100.

In some embodiments, HVAC system 100 is configured to monitor for, and take action in response to detecting, a refrigerant leak. For example, controller 120 may be configured to receive periodic (e.g., every 15 minutes) updates from gas sensor 160 indicating whether a leak is detected. In response to receiving an update that a leak is detected, controller 120 may provide instructions to HVAC system 100 to shut down operations. As another example, controller 120 may seek confirmation of a refrigerant leak from one or more other sensors before shutting down operation of HVAC system 100. As an example, in response to receiving an update from gas sensor 160 that a refrigerant leak is detected, controller 120 may instruct a subcool sensor and/or superheat sensor to confirm the refrigerant leak. In some embodiments, controller 120 shuts down operation of HVAC system 100 in response to receiving confirmation of the refrigerant leak from either the subcool sensor or superheat sensor. In other embodiments, controller 120 shuts down operation of HVAC system 100 in response to receiving confirmation of the refrigerant leak from both the subcool sensor and superheat sensor. Alternatively, this disclosure recognizes that controller 120 may instruct motor 115 to increase its speed to provide an air flowrate sufficient to mitigate the fire/flame risk until an operator can address the underlying issue with HVAC system 100.

This disclosure also recognizes performing one or more safety checks upon installation of HVAC system 100. Safety checks may include determining a baseline external static pressure for the HVAC system 100. Thus, controller 120 may receive data indicating an external static pressure of HVAC system 100 upon installation. An external static pressure measurement above or near a maximum external static pressure (e.g., 0.9 inch wc) may be concerning to an installer, manufacturer, and/or installer of HVAC system 100 as an HVAC system having an elevated external static pressure is associated with increased risk to provide $Q_s$ for refrigerants. Another safety check that may be performed upon installation is a baseline air flowrate check wherein an installer may verify that the HVAC system is capable of achieving the $Q_s$ for the type and weight of refrigerant circulating in HVAC system 100.

Figure 2:
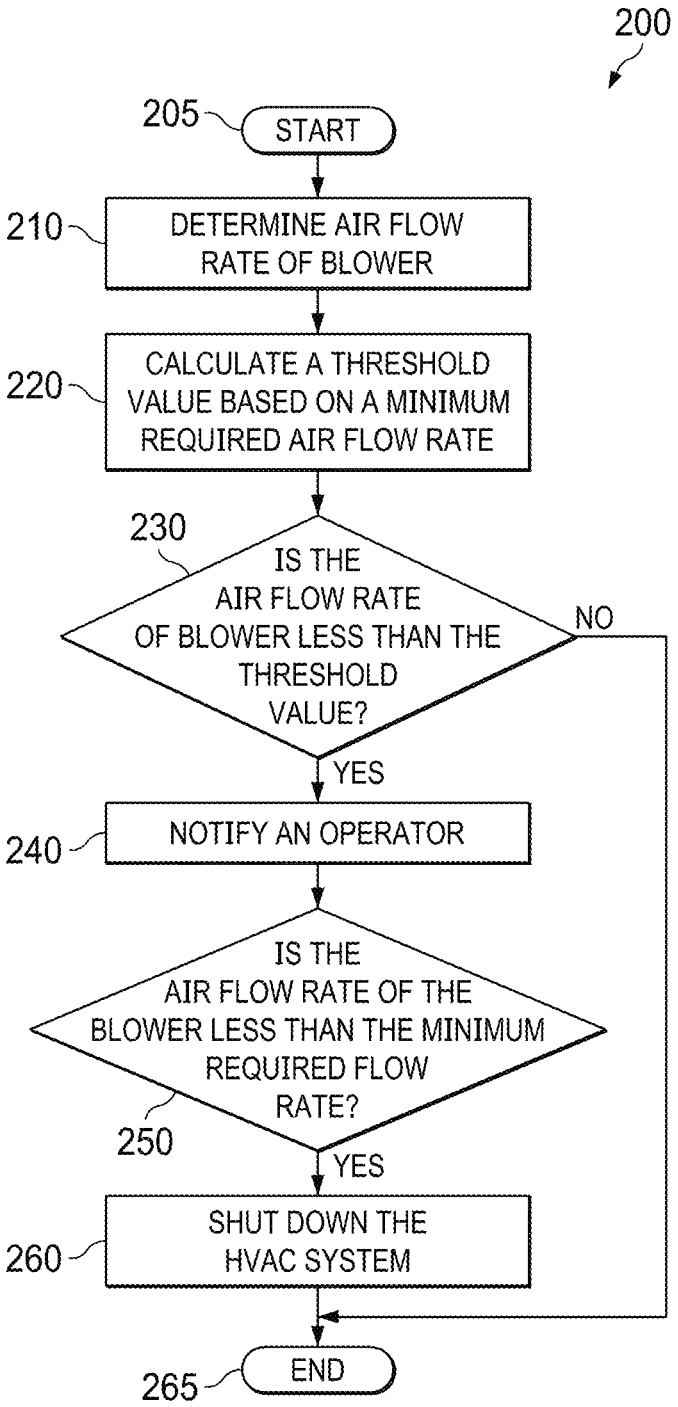
FIG. 2 depicts a flow chart illustrating a method of operation for at least one controller associated with the HVAC system of FIG. 1, according to one embodiment.

FIG. 2 illustrates a method 200 of operation for HVAC system 100. In some embodiments, the method 200 may be implemented by a controller of HVAC system 100 (e.g., controller 120 of FIG. 1). As described above, method 200 may be stored on a computer readable medium, such as a memory of controller 120 (e.g., memory 420 of FIG. 4), as a series of operating instructions that direct the operation of a processor (e.g., processor 430 of FIG. 4). Method 200 may be associated with safety benefits and efficiency benefits as described above. In some embodiments, the method 200 begins in step 205 and continues to step 210.

At step 210, controller 120 determines an air flowrate of blower 110. In some embodiments, the air flowrate of blower 110 is determined by motor 115 and that information is relayed to controller 120. In other embodiments, controller 120 calculates the air flowrate of blower 110 by receiving data such as torque and RPM from motor 115. In some embodiments, the method proceeds to a step 220 upon determining the air flowrate of blower 110.

At step 220, controller 120 calculates a threshold value based on a minimum required air flowrate (e.g., $Q_s$). In some embodiments, the threshold value is calculated as a percentage above the minimum required air flowrate (e.g., 25% above the minimum required air flowrate). As an example, the threshold value may be 916.25 CFM for an HVAC system circulating 14 pounds of R32. As described above, controller 120 may store information regarding refrigerants and their corresponding LFL such that controller 120 may calculate the $Q_s$ for a particular refrigerant. Controller 120 may also store information regarding the refrigerant circulating through HVAC system 100 (e.g., type/weight of refrigerant circulating in HVAC system 100). In other embodiments, a manufacturer and/or operator may communicate such information to controller 120 such that controller 120 can determine $Q_s$ for the refrigerant circulating through HVAC system 100. Upon determining the $Q_s$ for the refrigerant circulating through HVAC system 100, controller 120 may further determine a threshold value for a particular $Q_s$. In some embodiments, threshold value is determined based on calculating the threshold value as a product of $Q_s$ and a percentage above $Q_s$ (e.g., multiply $Q_s$ by 1.25 when the predetermined threshold is 25% above $Q_s$). In some embodiments, the method 200 proceeds to a step 230 upon determining the threshold value.

At step 230, controller 120 determines whether the air flowrate of blower 110 is less than the threshold value. Such determination may be made by comparing the air flowrate of blower 110 to the threshold value. If at step 230, controller 120 determines that the air flowrate of blower 110 is less than the threshold value, the method 200 may proceeds to a step 240. If however, at step 230, controller 120 determines that the air flowrate of blower 110 is not less than the threshold value, the method 200 may proceed to an end step 265. As an example, if at step 210 controller 120 determines that the air flowrate of blower 110 is 900 CFM and at step 220 controller 120 determines that the threshold value is 916.25 CFM, the method 200 may proceed to step 240. In contrast, if controller 120 determined at step 210 that air flowrate of blower 110 is 1200 CFM and determined at step 220 that threshold value is 916.25 CFM, the method 200 may proceed to end step 265.

At step 240, controller 120 sends a notification to an operator of HVAC system 100. Such notification may indicate that the air flowrate of blower 110 is less than the threshold value. Receiving such notification may prompt an operator to take action (e.g., investigate issue with HVAC system, change air filter 150). In some embodiments, the method 200 proceeds to end step 265. In other embodiments, the method 200 proceeds to a step 250.

At step 250, controller 120 determines whether the air flowrate of blower 110 is less than the minimum required flowrate. As described above the minimum required flowrate may represent the $Q_s$ for a particular weight of refrigerant circulating through HVAC system. Thus, at step 250, controller determines whether the blower is maintaining an air flowrate sufficient to dilute and/or mix the refrigerant circulating through HVAC system. If at step 250, controller 120 determines that the air flowrate of blower 110 is not less than (i.e., greater than or equal to) the $Q_s$ for the refrigerant circulating through HVAC system 100, the method 200 may proceed to an end step 265. If however, at step 250, controller 120 determines that the air flowrate of blower 110 is less than the $Q_s$ for the refrigerant circulating through HVAC system 100, the method 200 may proceed to a step 260.

At step 260, controller 120 shuts down the operation of HVAC system 100 such that the refrigerant is no longer circulated by the componentry of the HVAC system 100. In some cases, ceasing operation of HVAC system 100 may mitigate the risk of fire/flame due to the use of flammable refrigerant in HVAC system 100. In some embodiments, the method 200 proceeds to an end step 265 upon shutting down HVAC system 100.

Method 200 may include one or more additional steps. For example, as explained above, controller 120 may monitor the air flowrate of blower 110 and/or the external static pressure and send notifications indicative of an issue with HVAC system 100. As another example, controller 120 may monitor HVAC system 100 for refrigerant leaks and take actions in response to determining that a leak exists.

Figure 3:
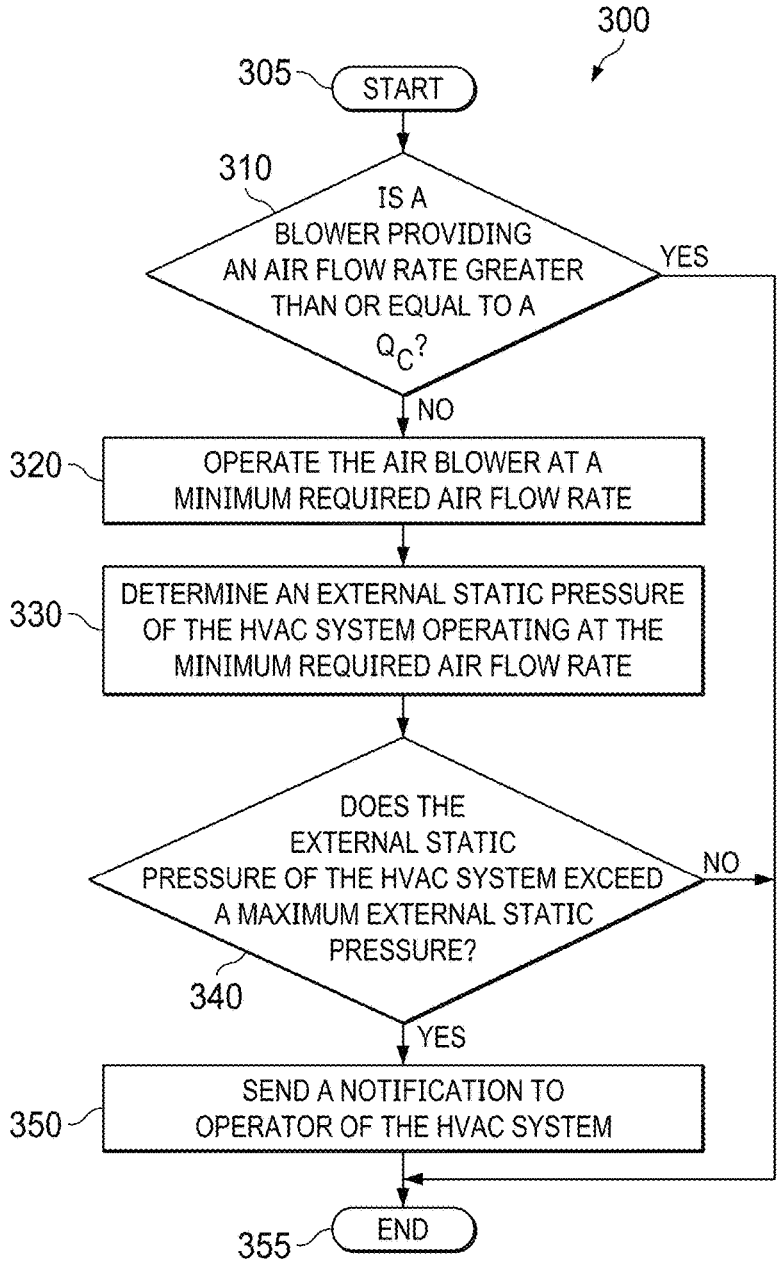
FIG. 3 depicts a flow chart illustrating a method of operation for at least one controller associated with the HVAC system of FIG. 1, according to another embodiment.

FIG. 3 illustrates a method 300 of operation for HVAC system 100. In some embodiments, the method 300 may be implemented by a controller of HVAC system 100 (e.g., controller 120 of FIG. 1). As described above, method 300 may be stored on a computer readable medium, such as a memory of controller 120 (e.g., memory 420 of FIG. 4), as a series of operating instructions that direct the operation of a processor (e.g., processor 430 of FIG. 4). Method 300 may be associated with safety benefits and efficiency benefits as described above. This disclosure recognizes that the method 300 may be implemented periodically (e.g., once every 24 hours). In some embodiments, the method 300 begins in step 305 and continues to step 310.

At step 310, controller 120 determines whether blower 110 is providing an air flowrate greater than or equal to a $Q_c$. As explained above, $Q_c$ varies by person but is typically between 200 and 400 CFM per ton. Thus, for a 5-ton HVAC system configured to have a $Q_c$ of 1000 CFM, controller 120 would determine whether blower 110 is providing an air flowrate greater than or equal to 1000 CFM. If blower 110 is providing an air flowrate greater than or equal to the $Q_c$, the method 300 proceeds to an end step 355. If however, at step 310, controller 120 determines that blower 110 is not providing an air flowrate greater than or equal to the $Q_c$, the method 300 may proceed to a step 320.

At step 320, controller 120 operates air blower 110 at a minimum required air flowrate. In some embodiments, the minimum required air flowrate corresponds to the LFL for the particular type and weight of refrigerant circulating through HVAC system 100. If the above-mentioned 5-ton HVAC system is circulating 14 pounds of R32, controller 120 may provide instructions to motor 115 to operate blower 110 at approximately 843 CFM. In some embodiments, the method 300 proceeds to a step 330 once HVAC system 100 is operating at the minimum required air flowrate.

At step 330, controller 330 determines an external static pressure of HVAC system 100 while it is operating at the minimum required air flowrate. As described above, the external static pressure of HVAC system 100 may be determined by one or more pressure sensor 160 and relayed to controller 120. In some embodiments, the method 300 proceeds to a step 340 upon completion of step 330.

At step 340, controller 120 determines whether the external static pressure of the HVAC system exceeds a maximum external static pressure. In some embodiments, the maximum external static pressure is a threshold set by a manufacturer and/or operator of HVAC system 100. As an example, the maximum external static pressure may be 0.9 inch wc. If at step 340, controller 120 determines that the external static pressure of HVAC system 100 does not exceed the maximum external static pressure, the method 300 proceeds to end step 355. If, however, at step 340, controller 120 determines that the external static pressure of HVAC system 100 exceeds the maximum external static pressure, the method 300 may proceed to a step 350.

At step 350, controller 120 sends a notification to an operator of HVAC system 100 indicating that the maximum external static pressure is exceeded. Receiving such notification may prompt an operator to take action (e.g., investigate issue with HVAC system, change air filter 150). In some embodiments, the method 300 proceeds to end step 355 upon completing step 350.

Figure 4:
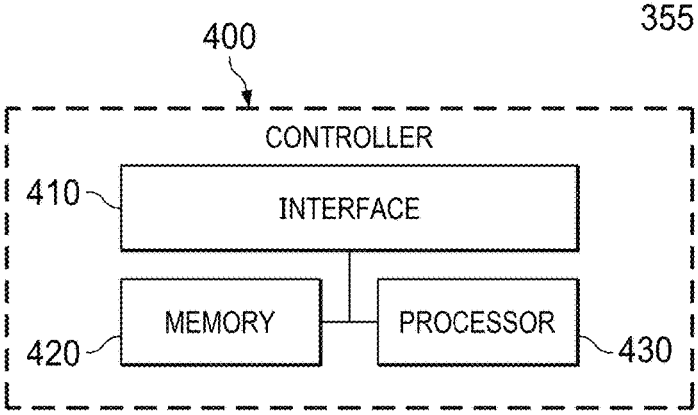
FIG. 4 illustrates an example of a controller for an HVAC system that is operable to perform the methods illustrated in FIGS. 2 and 3, according to certain embodiments.

FIG. 4 illustrates an example controller 400 of HVAC system 100, according to certain embodiments of the present disclosure. Controller 400 may comprise one or more interfaces 410, memory 420, and one or more processors 430. Interface 410 receives input (e.g., sensor data, user input), sends output (e.g., instructions), processes the input and/or output, and/or performs other suitable operation. Interface 410 may comprise hardware and/or software.

Processor 430 may include any suitable combination of hardware and software implemented in one or more modules to execute instructions and manipulate data to perform some or all of the described functions of controller 400. In some embodiments, processor 430 may include, for example, one or more computers, one or more central processing units (CPUs), one or more microprocessors, one or more applications, one or more application specific integrated circuits (ASICs), one or more field programmable gate arrays (FPGAs), and/or other logic.

Memory (or memory unit) 420 stores information. Memory 420 may comprise one or more non-transitory, tangible, computer-readable, and/or computer-executable storage media. Examples of memory 420 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, the HVAC system may include any suitable number of compressors, condensers, condenser fans, evaporators, valves, sensors, controllers, and so on, as performance demands dictate. One skilled in the art will also understand that the HVAC system contemplated by this disclosure can include other components that are not illustrated but are typically included with HVAC systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A heating, ventilation, and air condition ("HVAC") system operable to condition an enclosed space, the HVAC system comprising:

an air blower operable to push air into the enclosed space; and a controller comprising processing circuitry and a computer readable storage medium comprising instructions that, when executed by the processing circuitry, cause the controller to:

determine an air flowrate of the air blower;

calculate a threshold value based on a minimum required air flowrate, wherein:

a minimum air flowrate is calculated based on a mass of a refrigerant circulating in the HVAC system and a lower flammability limit corresponding to the refrigerant; and the threshold value is greater than the minimum air flowrate;

in response to determining that the air flowrate of the air blower is less the threshold value, send a notification to an operator of the HVAC system indicating that the air flowrate of the air blower is less than the threshold value; and in response to determining that the air flowrate of the air blower is less than the minimum required air flowrate, shut down the HVAC system such that the refrigerant is no longer circulating in the HVAC system.

2. The system of claim 1, wherein:

the HVAC system further comprises a gas sensor configured to detect a refrigerant leak of the HVAC system; and the controller comprises further instructions that, when executed by the processing circuitry, cause the controller to operate the blower in response to detecting the refrigerant leak.

3. The system of claim 1, wherein:

the HVAC system further comprises one or more of a subcool sensor or a superheat sensor wherein each of the subcool sensor and the superheat sensor is configured to detect a refrigerant leak of the HVAC system; and the controller comprises further instructions that, when executed by the processing circuitry, cause the controller to operate the blower in response to detecting the refrigerant leak.

4. The system of claim 1, wherein the controller determines the air flowrate of the air blower by receiving data from a motor of the air blower.

5. The system of claim 1, wherein the threshold value is less than a comfort setpoint.

6. The system of claim 1, wherein the controller further comprises instructions that, when executed by the processing circuitry, cause the controller to:

determine that the air flowrate of the air blower is decreasing over a period of time; and send a notification to an operator of the HVAC system indicating that a change in air filter is needed.

7. The system of claim 1, wherein the controller comprises instructions that, when executed by the processing circuitry, cause the controller to:

upon determining that the air blower cannot provide an air flowrate equal to or above a comfort setpoint:

operate the air blower at the minimum required air flowrate;

determine an external static pressure of the HVAC system when the air blower is operating at the minimum required air flowrate;

in response to determining that the external static pressure of the HVAC system exceeds a maximum external static pressure of the HVAC system, send a notification to an operator of the HVAC system indicating that external static pressure of the HVAC system exceeds the maximum external static pressure of the HVAC system.

8. The system of claim 7, wherein the controller determines the external static pressure by receiving data from a motor of the air blower.

9. A method for a heating, ventilation, and air conditioning ("HVAC") system, the method comprising:

determining, by one or more controllers of the HVAC system, an air flowrate of an air blower of the HVAC system;

calculating, by the one or more controllers, a threshold value based on a minimum required air flowrate, wherein:

a minimum air flowrate is calculated based on a mass of a refrigerant circulating in the HVAC system and a lower flammability limit corresponding to the refrigerant; and the threshold value is greater than the minimum air flowrate;

in response to determining that the air flowrate of the air blower is less the threshold value, sending, by the one or more controllers, a notification indicating that the air flowrate of the air blower is less than the threshold value; and in response to determining that the air flowrate of the air blower is less than the minimum required air flowrate, shutting down, by the one or more controllers, the HVAC system such that the refrigerant is no longer circulating in the HVAC system.

10. The method of claim 9, further comprising:

detecting, by a gas sensor, a refrigerant leak of the HVAC system; and operate, by the one or more controllers, the blower in response to detecting the refrigerant leak.

11. The method of claim 9, further comprising:

detecting, by one or more of a subcool sensor or a superheat sensor, a refrigerant leak; and operate, by the one or more controllers, the blower in response to detecting the refrigerant leak.

12. The method of claim 9, wherein the one or more controllers determine the air flowrate of the air blower by receiving data from a motor of the air blower.

13. The method of claim 9, wherein the threshold value is less than a comfort setpoint.

14. The method of claim 9, further comprising:

determining, by the one or more controllers, that the air flow rate of the air blower is decreasing over a period of time; and sending, by the one or more controllers, a notification to an operator of the HVAC system indicating that a change in air filter is needed.

15. The method of claim 9, further comprising:

upon determining, by the one or more controllers, that the air blower cannot provide an air flowrate equal to or above a comfort setpoint operate the air blower at the minimum required air flowrate:

determining, by the one or more controllers, an external static pressure of the HVAC system when the air blower is operating at the minimum required air flowrate;

in response to determining that the external static pressure of the HVAC system exceeds a maximum external static pressure of the HVAC system, sending, by the one or more controllers, a notification to an operator of the HVAC system indicating that external static pressure of the HVAC system exceeds the maximum external static pressure of the HVAC system.

16. The method of claim 15, wherein the one or more controllers determine the external static pressure by receiving data from a motor of the air blower.

17. A controller comprising processing circuitry and a computer readable storage medium comprising instructions that, when executed by the processing circuitry, cause the controller to:

determine an air flowrate of an air blower of the HVAC system;

calculate a threshold value based on a minimum required air flowrate, wherein:

a minimum air flowrate is calculated based on a mass of a refrigerant circulating in the HVAC system and a lower flammability limit corresponding to the refrigerant; and the threshold value is greater than the minimum air flowrate;

in response to determining that the air flowrate of the air blower is less the threshold value, send a notification indicating that the air flowrate of the air blower is less than the threshold value; and in response to determining that the air flowrate of the air blower is less than the minimum required air flowrate, shut down the HVAC system such that the refrigerant is no longer circulating in the HVAC system.

18. The controller of claim 17, further comprising instructions that, when executed by the processing circuitry, cause the controller to operate, by the one or more controllers, the blower in response to detecting a refrigerant leak.

19. The controller of claim 17, further comprising instructions that, when executed by the processing circuitry, cause the controller to:

determine that the air flow rate of the air blower is decreasing over a period of time; and send a notification to an operator of the HVAC system indicating that a change in air filter is needed.

20. The controller of claim 17, further comprising instructions that, when executed by the processing circuitry, cause the controller to:

upon determining that the air blower cannot provide an air flowrate equal to or above a comfort setpoint operate the air blower at the minimum required air flowrate:

determine an external static pressure of the HVAC system when the air blower is operating at the minimum required air flowrate; and in response to determining that the external static pressure of the HVAC system exceeds a maximum external static pressure of the HVAC system, send a notification to an operator of the HVAC system indicating that external static pressure of the HVAC system exceeds the maximum external static pressure of the HVAC system.

* * * * *